US005346126A

United States Patent [19]

Lai

[11] Patent Number: 5,346,126

[45] Date of Patent: Sep. 13, 1994

[54] DEVICE FOR CONTROLLING HEATING EFFICIENCY OF WATER HEATER

[76] Inventor: Shin-Chang Lai, No. 1, Lane 3, Dien-Chou, South District, Taichung, Taiwan

[21] Appl. No.: 77,776

[22] Filed: May 6, 1993

[51] Int. Cl.[5] ..... F23N 3/00

[52] U.S. Cl. ..... 236/1 G; 236/45; 126/285 R

[58] Field of Search ..... 236/45, 1 G; 126/285 R, 126/290

[56] References Cited

U.S. PATENT DOCUMENTS 4,460,121 7/1984 Hedrick ..... 236/45

*Primary Examiner*—Carroll B. Dority

*Attorney, Agent, or Firm*—Browdy and Neimark

[57] ABSTRACT

A device for use in improving the heating efficiency of a water heater comprises a housing mounted over the heat collecting pieces of the water heater and provided with at least a set of ventilating ports, each of which is composed of a predetermined number of ventilation holes arranged in a geometric pattern. Pivoted to each of the ventilation holes is a damper, which can be triggered by a heat sensing element to turn so as to open or close automatically the ventiation holes. The heat sensing element is caused by heat to deform in order to bring about a displacement of the damper. The extent of the opening of the ventilation holes depends on the extent of the displacement of the damper.

7 Claims, 5 Drawing Sheets

DEVICE FOR CONTROLLING HEATING EFFICIENCY OF WATER HEATER

FIELD OF THE INVENTION

The present invention relates to a water heater, and more particularly to a device for use in regulating the rate of the exhaust fume of a water heater so as to enhance the heating efficiency of the water heater.

BACKGROUND OF THE INVENTION

As shown in FIG. 1, a prior art water heater 10 comprises a plurality of heat collecting pieces 12 arranged orderly in a row and a hollow metal body 14 provided respectively at both sides thereof with an opening 16 and with a V-shaped body 18. During the heating operation of the water heater 10, the exhaust fume so generated is let out in the directions indicated by the arrows. However, the exhaust fume is not let out directly through the exhaust holes 19 before the heat of the exhaust fume is absorbed by the heat collecting pieces 12. The heat so absorbed is then transmitted to heat the water in the water pipes which pass through the heat collecting pieces 12, which are generally inefficient in absorbing the heat. As a result, a substantial quantity of gas is wasted during the heating operation of the water heater 10 of the prior art.

SUMMARY OF THE INVENTION

It is therefore the primary objective of the present invention to provide a heating efficiency regulator of a water heater, which serves to enhance the heat-absorbing rate of the heat collecting pieces of the water heater so as to shorten the heating time and to conserve the energy.

In keeping with the principles of the present invention, the foregoing objective of the present invention is attained by a device which comprises a housing provided with a plurality of ventilation holes and located over a plurality of heat collecting pieces. The housing is provided with at least a set of ventilating ports, each of which has a predetermined number of ventilation holes arranged in a geometric pattern. The housing is further provided with a predetermined number of dampers, each of which is corresponding in shape to the ventilating port and is disposed movably at a position of the housing corresponding in location to the ventilating port so as to open or close the ventilating port. The device further comprises at least two heat sensing pieces, each of which is pivoted to the damper so that the heat sensing piece can activate the movement of the damper in accordance with a change in the temperature of the heat sensing piece.

DETAILED DESCRIPTION OF THE INVENTION

Figure 1:
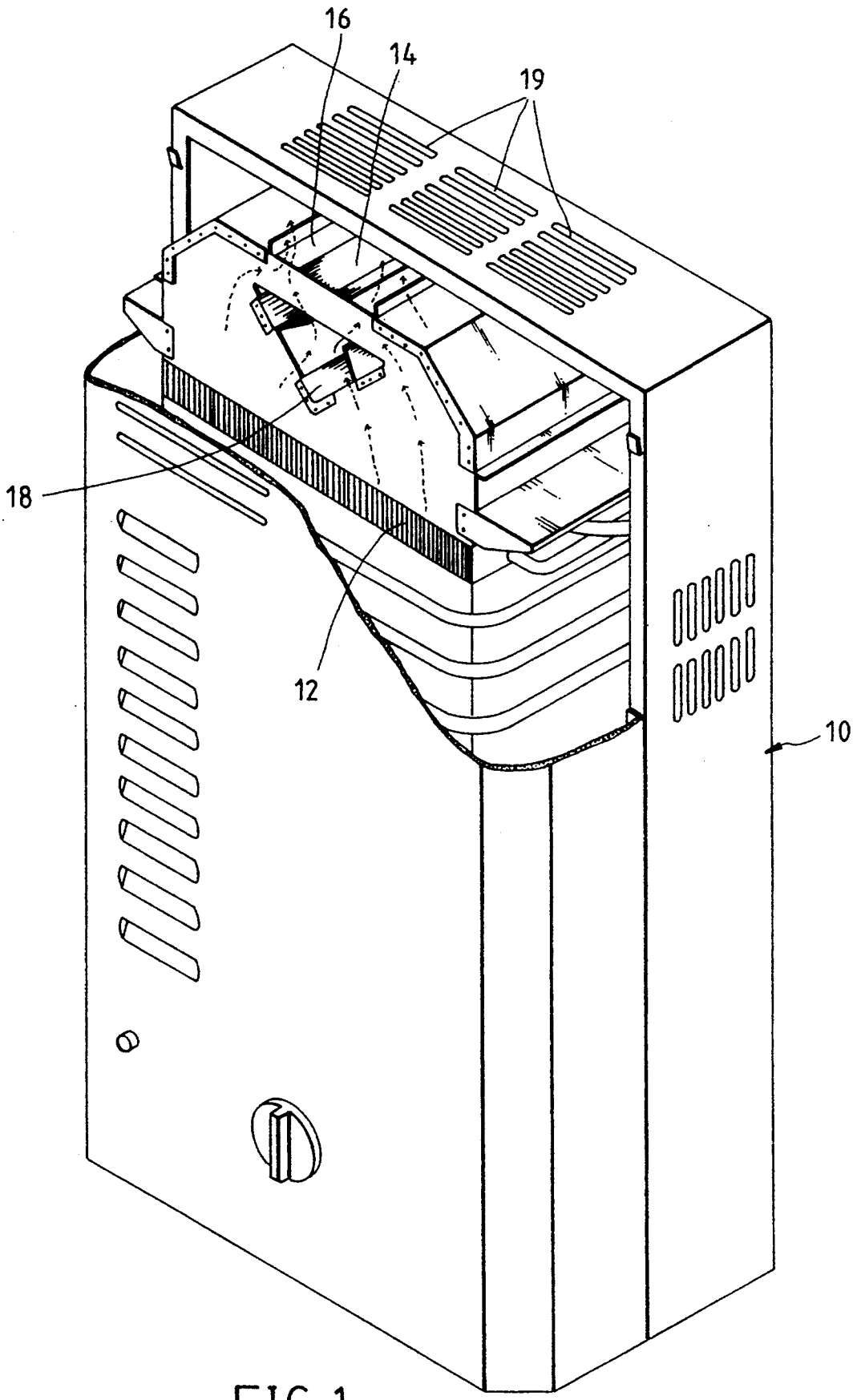
FIG. 1 PRIOR ART
FIG. 1 shows a schematic view of a fume exhausting structure of the prior art water heater.
Figure 2:
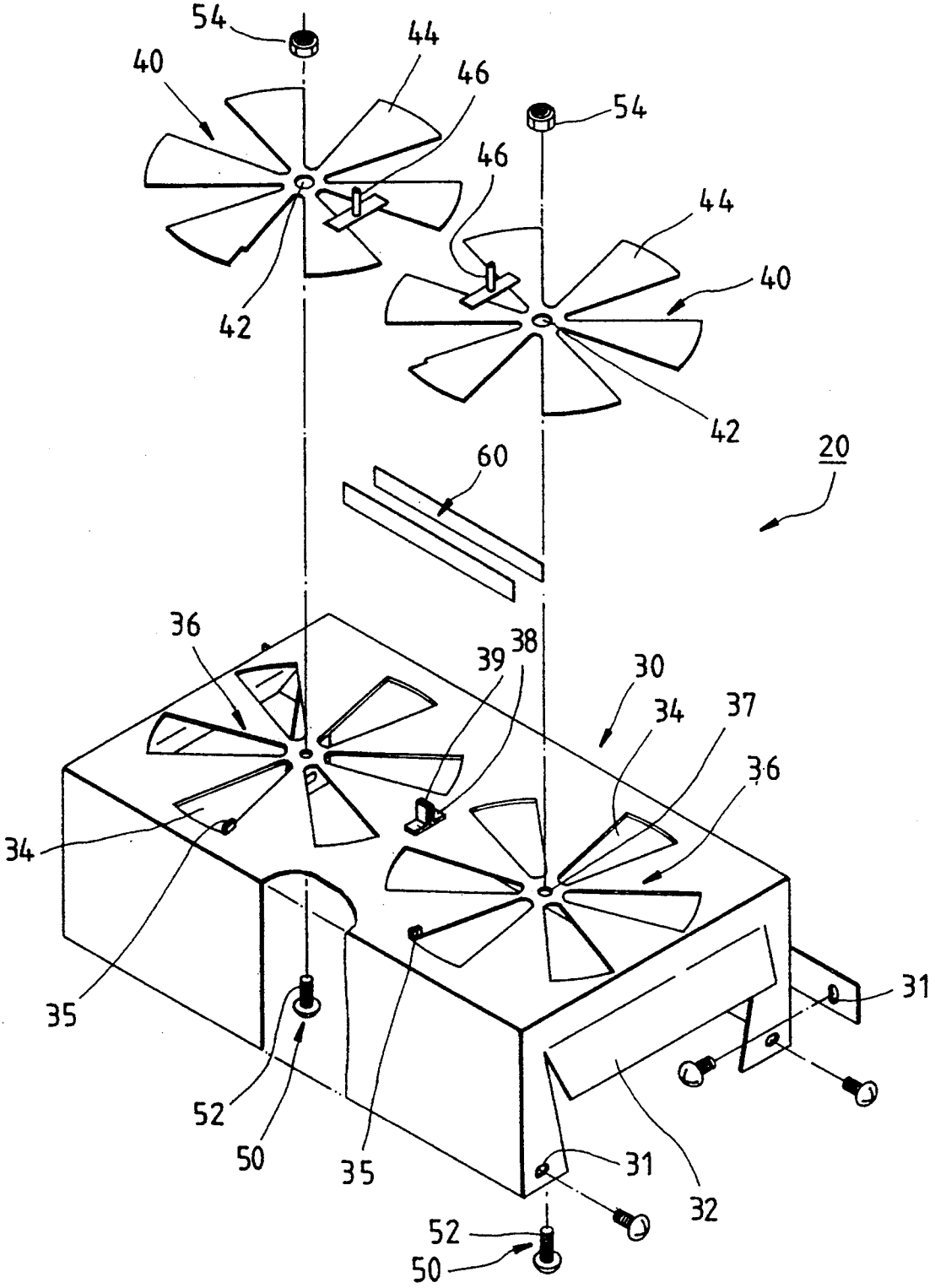
FIG. 2 shows a partial exploded view of the present invention.
Figure 3:
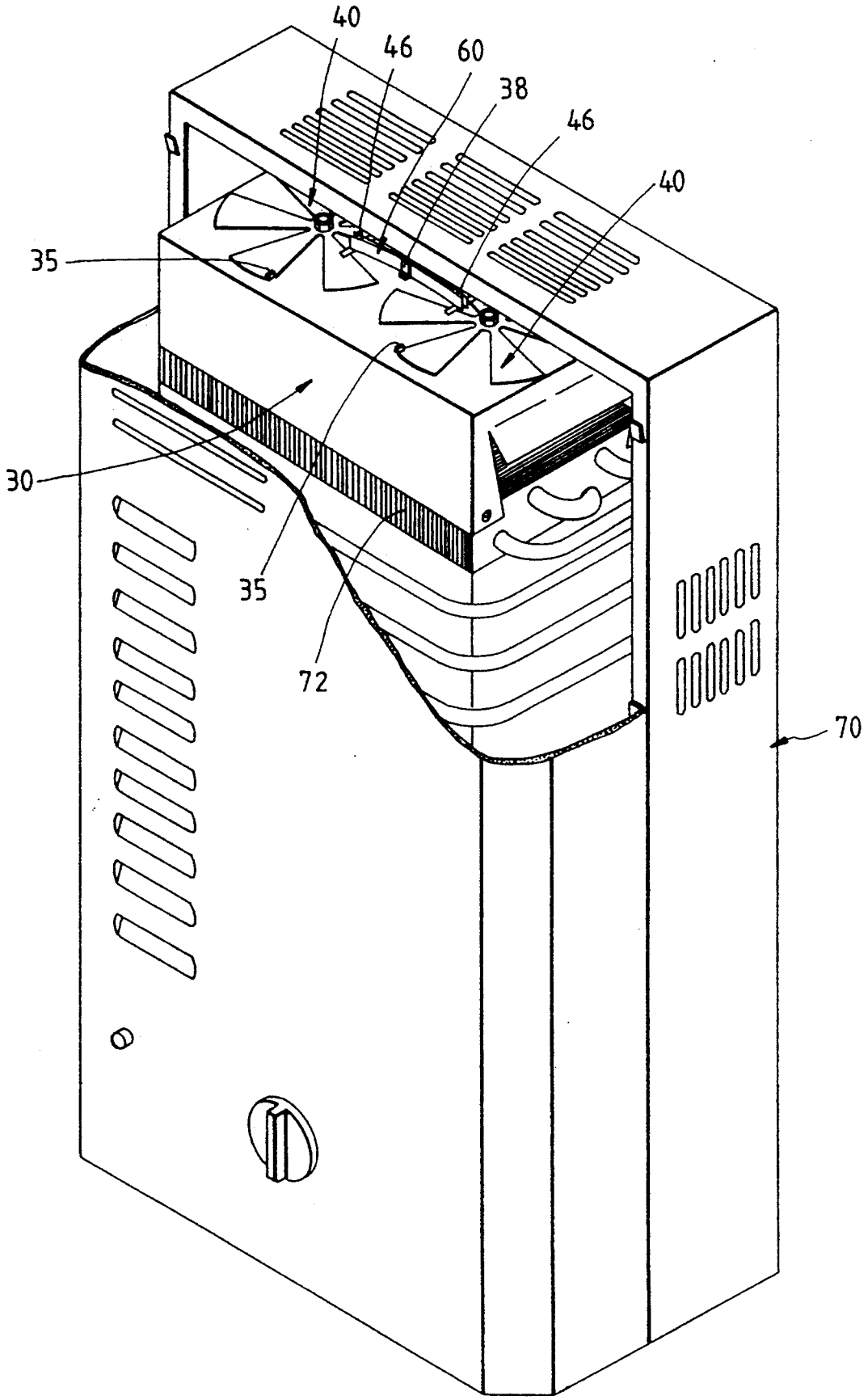
FIG. 3 is a schematic view showing that the device of the present invention is mounted in a water heater.

Referring to FIGS. 2 and 3, a heating efficiency regulating device 20 of the present invention is shown to comprise a housing 30, two dampers 40, two pivoting elements 50, and two heat sensing pieces 60.

The housing 30 of a bottomless construction is provided respectively at the lower four corners thereof and at two sides thereof with a penetration hole 31 engageable with a screw. The housing 30 is mounted over heat collecting pieces 72 in the water heater 70. Each of the two sides of the housing 30 is provided with an opening 32. The housing 30 has a top surface provided with two ventilating ports 36, each of which is composed of six sector ventilation holes 34 arranged circularly and equidistantly. Each of the ventilation holes 34 forms an angle of 30 degrees. Each of the two ventilating ports 36 is provided at the center thereof with a through bole 37. One of the ventilation holes 34 of each ventilating port 36 is provided at the edge thereof with a protruded stop portion 35. Located between the two ventilating ports 36 is an insertion mount 38 which is provided with an insertion slot 39.

Each of the two dampers 40 is made by punching and pressing and provided at the center thereof with a through hole 42 and composed of six sector pieces 44 arranged circularly and equidistantly. Each of the six sector pieces 44 is corresponding in location to each of the six ventilation holes 34. Each damper 40 is provided with a protruded pushing portion 46 between the two sector pieces 44.

The pivoting elements 5o are provided respectively with a bolt 52 and a nut 54. The damper 40 is pivoted to the housing 30 by means of the nut 54 and the bolt 52 which is received in the through holes 37 and 42. The rotating angle of the damper 40 is limited by means of the stop portion 35 which serves to obstruct the movement of the sector piece 44.

Each of the two heat sensing pieces 60 is made of a metal alloy, such as a beryllium copper alloy, or an aluminum copper alloy, or any other alloy capable of being bent and deformed by heat due to a difference in heat expansion coefficient. The heat sensing pieces 60 are retained in the insertion slots 39 of the insertion mounts 38 in such a manner that the heat sensing pieces 60 clamp and retain the pushing portions 46 of the dampers 40 so as to trigger the rotation of the dampers 40.

Figure 4:
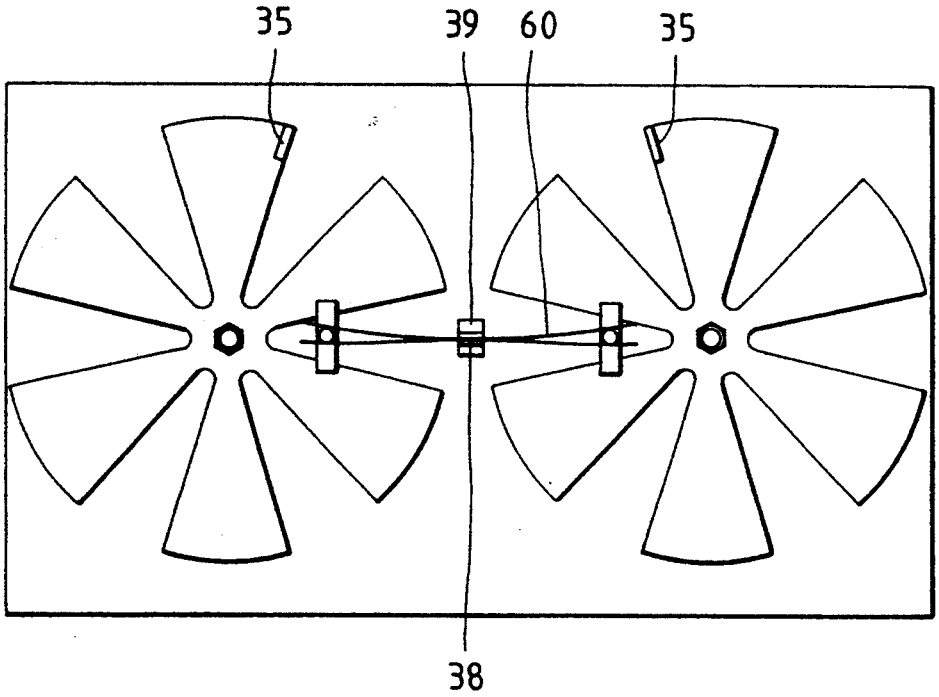
FIG. 4 is a schematic view showing that the present invention is turned off under a normal condition.

As shown in FIG. 4, when the water heater 70 is not at work, the two heat sensing pieces 60 have a straight form so that each of the sector pieces 44 of each of the two dampers 40 seals off each of the ventilation holes 34.

Figure 5:
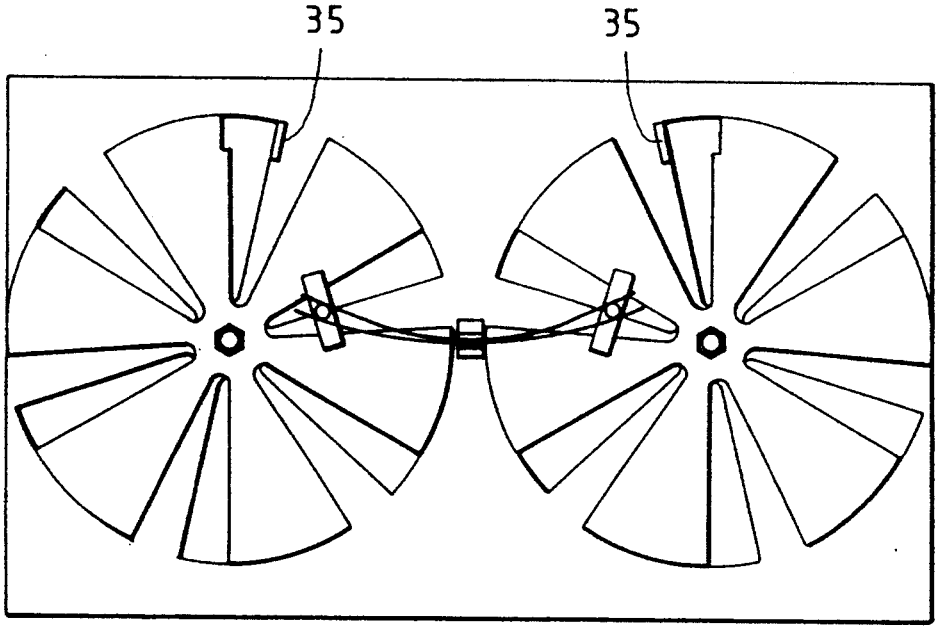
FIG. 5 is a schematic view showing that the present invention is at work.

As shown in FIG. 5, when the water heater 70 is heated with a gas flame of low intensity, the two heat sensing pieces 60 are caused by the heat to deform so as to trigger the two dampers 40 to become angularly displaced. As a result, the sector pieces 44 are so moved as to open slightly the ventilation holes 34. Since the ventilation holes 34 are opened only partially, the heat is allowed to remain inside the housing 30 for a longer period of time. In other words, the heat energy is properly conserved inside the housing 30 so that the heat-absorbing efficiency of the heat collecting pieces is improved.

Figure 6:
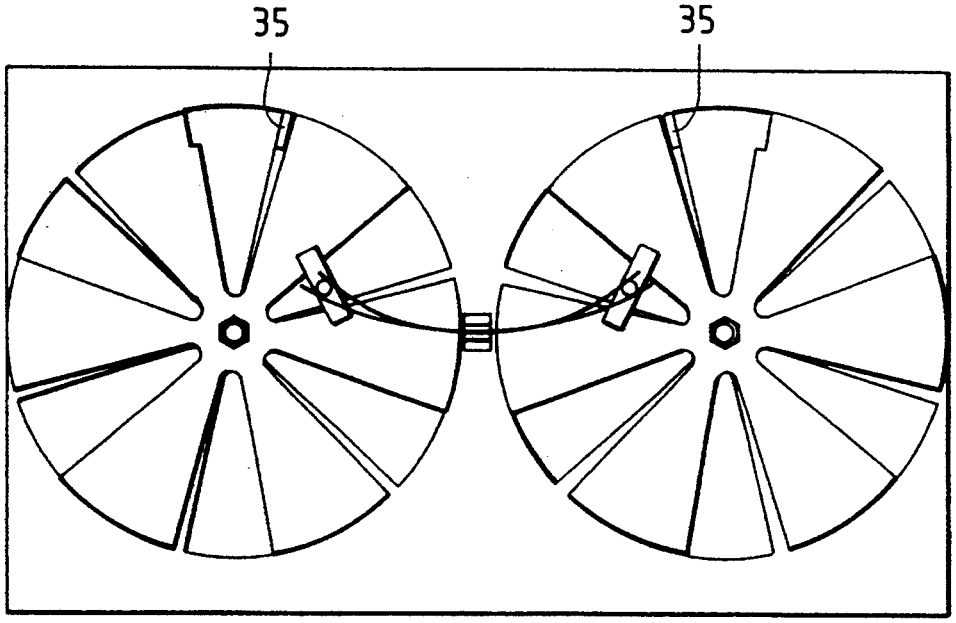
FIG. 6 is similar to FIG. 5, showing that the present invention is in full operation.

As shown in FIG. 6, when the gas flame heating the water heater 70 is so greatly intensified that the temperature inside the housing 30 reaches a certain point at which the heat-absorbing efficiency of the heat collecting pieces 72 reaches a certain level, the heat sensing pieces 60 are caused by the intensified heat to become substantially deformed, thereby resulting in a greater angular displacement of the dampers 40. The two stop portions 35 retain one of the sector pieces 44 so as to restrain the angular displacements of the dampers 40. As a result, the sector pieces 44 are so located that the ventilation holes 34 are opened completely to permit the cold air and the warm air to flow therethrough.

As soon as the water heater 70 is turned off, the heat sensing pieces 60 begin to regain their original form, so as to trigger the dampers 40 to turn back to their original positions. In the meantime, the two stop portions 35 retain another one of the sector pieces 44 so that the sector pieces 44 of the dampers 40 close all the ventilation holes 34 again, as shown in FIG. 4.

It must be noted here that the openings 32 of the housing 30 are intended for use in permitting the heat exchange of a mass of the generated hot air to take place. When there is a small quantity of the hot air generated by the water heater 70, the openings 32 play no role in causing the hot air to stay, in view of the fact that the hot air remains at the top portion of the housing 30.

The present invention has advantages over the prior art device, which are described hereinafter.

The ventilation holes of the present invention are opened and closed automatically in accordance with the intensity of the temperature of the hot air generated by the water heater.

According to the experiment conducted by the applicant of the present invention, it takes 30 seconds for the prior art water heater to warm the cold water up to a temperature of 45 degree in Celsius. With a gas flame of similar intensity, it takes only 20 seconds for a water heater, which is equipped with the device of the present invention, to warm the cold water up to 45 degrees in Celsius. Accordingly, the device of the present invention serves to conserve the energy by enhancing the heating efficiency of the water heater, thereby lowering the gas bill of the users of the water heater.

The embodiment of the present invention described above is to be regarded in all respects as merely illustrative and not restrictive. Accordingly, the present invention may be embodied in other specific forms without deviating from the spirit thereof. Therefore, the present invention is to be limited only by the scope of the following appended claims.

What is claimed is:

1. A device for controlling the heating efficiency of a water heater comprising:

a housing having a predetermined number of ventilation holes and mounted over heat collecting pieces inside a water heater;

a predetermined number of dampers, each of which is corresponding in shape and location to each of said ventilation holes and is movably mounted on said housing; and at least one heat sensing element mounted on said housing and pivoted to said dampers;

wherein said housing is provided with at least one set of ventilating port having a predetermined number of ventilation holes of geometric shape; and wherein said heat sensing element is subject to a deformation caused by a heat so as to trigger said dampers to open or close said ventilating port.

2. The device according to claim 1 wherein said ventilation holes are arranged circularly and equidistantly; and wherein each of said dampers is of circular construction and is provided with sector pieces corresponding in number and location to said ventilation holes, said each of said dampers being pivoted at the center thereof to the center of said ventilating port.

3. The device according to claim 2 wherein at least one of said ventilation holes of said ventilating port is provided at the edge thereof with a stop portion intended to retain said sector pieces.

4. The device according to claim 1 wherein said housing is provided with at least one insertion mount; wherein each of said dampers is provided with a protruded pushing portion; and wherein said heat sensing element is mounted in said insertion mount such that one end of said heat sensing element is coupled with said pushing portion of said each of said dampers.

5. The device according to claim 2 wherein said housing is provided with at least one insertion mount; wherein each of said dampers is provided with a protruded pushing portion; and wherein said heat sensing element is mounted in said insertion mount such that one end of said heat sensing element is coupled with said pushing portion of said each of said dampers.

6. The device according to claim 5 wherein said housing is provided with an insertion mount located between two ventilating ports; and wherein said heat sensing element is mounted in said insertion mount such that both ends of said heat sensing element extend beyond said dampers and are coupled respectively with said pushing portions of said dampers.

7. The device according to claim 2 wherein said ventilation holes and said sector pieces are of sectoral construction.

* * * * *

UNITED STATES PATENT AND TRADEMARK OFFICE

CERTIFICATE OF CORRECTION

PATENT NO. : 5,346,126
DATED : September 13, 1994
INVENTOR(S) : Shin-Chang LAI

It is certified that error appears in the above-indentified patent and that said Letters Patent is hereby corrected as shown below:

On the title page, item [21], delete "77,776" and insert therefor --57,776--.

Signed and Sealed this

Tenth Day of January, 1995

*Attest:*

*Attesting Officer*

BRUCE LEHMAN

*Commissioner of Patents and Trademarks*